US011554470B2

(12) United States Patent
McKenzie et al.

(10) Patent No.: US 11,554,470 B2
(45) Date of Patent: Jan. 17, 2023

(54) EXTRACTOR SOCKET WITH BIDIRECTIONAL DRIVING CAPABILITY AND CORRESPONDING EXTRACTION SET WITH INTERMEDIATE SIZES

(71) Applicant: APEX BRANDS, INC., Apex, NC (US)

(72) Inventors: Timothy T. McKenzie, Westminster, MD (US); Zhihong Fu, Cary, NC (US)

(73) Assignee: APEX BRANDS, INC., Apex, NC (US)

( * ) Notice: Subject to any disclaimer, the term of this patent is extended or adjusted under 35 U.S.C. 154(b) by 295 days.

(21) Appl. No.: 16/204,134

(22) Filed: Nov. 29, 2018

(65) Prior Publication Data

US 2019/0176310 A1 Jun. 13, 2019

Related U.S. Application Data

(60) Provisional application No. 62/598,005, filed on Dec. 13, 2017.

(51) Int. Cl.

| | |
|---|---|
| ***B25B 27/18*** | (2006.01) |
| ***B25B 13/06*** | (2006.01) |
| ***B25B 23/10*** | (2006.01) |

(52) U.S. Cl.

CPC ..... *B25B 27/18* (2013.01); *B25B 13/065* (2013.01); *B25B 23/105* (2013.01)

(58) Field of Classification Search

CPC ..... B25B 27/18; B25B 13/065; B25B 23/105; B25B 23/103; B25B 27/143;

(Continued)

(56) References Cited

U.S. PATENT DOCUMENTS 1,590,200 A * 6/1926 Mcguckin ..... B25B 27/0057 74/543
3,273,430 A * 9/1966 Knudsen ..... B25B 13/065 81/124.6

(Continued)

FOREIGN PATENT DOCUMENTS

CN 2291994 Y 9/1998
CN 103072106 A 5/2013

(Continued)

OTHER PUBLICATIONS

Office Action from related CN application No. 201811523244.2 dated Apr. 26, 2020.

(Continued)

*Primary Examiner* — Robert J Scruggs
(74) *Attorney, Agent, or Firm* — Burr & Forman LLP

(57) ABSTRACT

A bidirectional extraction socket may include a driven end configured to receive drive power from a driving tool, a drive end configured to interface with a fastener, and a body portion extending between the driven end and the drive end about an axis of the extraction socket. The drive end includes a fastener engagement recess extending into the body portion and coaxial with the body portion. The fastener engagement recess is configured to engage with the fastener such that the fastener is drivable in either a clockwise or a counterclockwise direction while avoiding contact with corner portions of the fastener.

16 Claims, 11 Drawing Sheets

(58) Field of Classification Search
CPC ..... B25B 13/5075; B25B 13/48; B25B 27/02; B25B 13/06; B25B 23/10
See application file for complete search history.

(56) References Cited

U.S. PATENT DOCUMENTS

| | | | | | |
|---|---|---|---|---|---|
| 4,126,063 | A * | 11/1978 | Palmer | B25B 13/065 | 81/124.6 |
| 4,671,141 | A * | 6/1987 | Hanson | B25B 13/065 | 81/441 |
| 4,882,957 | A * | 11/1989 | Wright | B25B 13/065 | 81/121.1 |
| 4,982,627 | A * | 1/1991 | Johnson | B23B 31/005 | 81/121.1 |
| 5,219,392 | A * | 6/1993 | Ruzicka | B25B 13/065 | 81/124.3 |
| 5,476,024 | A * | 12/1995 | Hsieh | B25B 13/065 | 81/121.1 |
| 6,003,411 | A * | 12/1999 | Knox | B25B 27/18 | 81/124.3 |
| 6,354,175 | B1 * | 3/2002 | Dobson | B25B 13/04 | 81/119 |
| 6,598,498 | B1 * | 7/2003 | Pigford | B25B 13/065 | 81/53.2 |
| 6,626,067 | B1 * | 9/2003 | Iwinski | B25B 13/065 | 411/403 |
| 6,877,402 | B1 * | 4/2005 | Pigford | B25B 27/18 | 81/53.2 |
| D570,169 | S | 6/2008 | Lin | | |
| 7,523,688 | B2 * | 4/2009 | Putney | F16D 1/101 | 81/125 |
| 9,186,782 | B2 * | 11/2015 | Banks | B25B 21/002 | |
| 9,272,395 | B2 * | 3/2016 | Hui | B25B 13/065 | |
| 9,381,624 | B1 * | 7/2016 | Patterson | B25B 13/065 | |
| 2010/0154602 | A1 * | 6/2010 | Piper | B25B 13/065 | 81/121.1 |
| 2013/0032009 | A1 * | 2/2013 | Hui | B25B 13/06 | 81/124.6 |

FOREIGN PATENT DOCUMENTS

| | | | |
|---|---|---|---|
| CN | 209774481 U | | 12/2019 |
| DE | 202005007853 | * | 8/2005 |
| DE | 202005007853 U1 | | 9/2005 |
| TW | 200621436 A | | 7/2006 |

OTHER PUBLICATIONS

Partial European Search Report for corresponding European Application No. 18211218.5, dated Nov. 11, 2019.
Partial European Search Report for corresponding European Application No. 18211218.5, dated Aug. 8, 2019.
Office Action from related CN application No. 201811523244.2 dated Nov. 9, 2020.
Communication pursuant to Article 94(3) EPC in corresponding European Application No. 18211218.5, dated Apr. 9, 2021.
Office Action in related Chinese application No. 201811523244.2, dated Apr. 25, 2021.

* cited by examiner 310 330 332 350

| Extractor Socket Size | | | SOCKET ID (MM) TOP | SOCKET ID (MM) BOTTOM | SOCKET ID (INCH) (A) TOP | SOCKET ID (INCH) (B) BOTTOM | OD (INCH) (C) OD | Length of Taper (D) INCH |
|---|---|---|---|---|---|---|---|---|
| 1 | "half" size | -1/4" | 6.101 | 5.852 | 0.240 | 0.230 | 0.424 | 0.110 |
| 2 | standard | 1/4" | 6.350 | 6.101 | 0.250 | 0.240 | 0.424 | 0.110 |
| 3 | "half" size | -7 mm | 6.750 | 6.500 | 0.266 | 0.256 | 0.456 | 0.118 |
| 4 | standard | 7 MM | 7.000 | 6.750 | 0.276 | 0.266 | 0.456 | 0.118 |
| 5 | "half" size | -8 mm (-5/16") | 7.750 | 7.500 | 0.305 | 0.295 | 0.500 | 0.152 |
| 6 | standard | 8 MM (5/16") | 8.000 | 7.750 | 0.315 | 0.305 | 0.500 | 0.152 |
| 7 | "half" size | -3/8" | 9.276 | 9.027 | 0.365 | 0.355 | 0.669 | 0.170 |
| 8 | standard | 3/8" | 9.525 | 9.276 | 0.375 | 0.365 | 0.669 | 0.170 |
| 9 | "half" size | -10 mm | 9.750 | 9.500 | 0.384 | 0.374 | 0.669 | 0.172 |
| 10 | standard | 10 MM | 10.000 | 9.750 | 0.394 | 0.384 | 0.669 | 0.172 |
| 11 | "half" size | -11 mm (-7/16") | 10.824 | 10.574 | 0.426 | 0.416 | 0.697 | 0.188 |
| 12 | standard | 11 MM (7/16") | 11.074 | 10.824 | 0.436 | 0.426 | 0.697 | 0.188 |
| 13 | "half" size | -12 mm | 11.750 | 11.500 | 0.463 | 0.453 | 0.763 | 0.228 |
| 14 | standard | 12 MM | 12.000 | 11.750 | 0.472 | 0.463 | 0.763 | 0.228 |
| 15 | "half" size | -1/2" | 12.446 | 12.192 | 0.490 | 0.480 | 0.800 | 0.265 |
| 16 | "half" mm / std in | -13 mm (1/2") | 12.750 | 12.500 | 0.502 | 0.492 | 0.800 | 0.265 |
| 17 | standard | 13 MM | 13.000 | 12.750 | 0.512 | 0.502 | 0.800 | 0.265 |
| 18 | "half" size | -14 mm | 13.750 | 13.500 | 0.541 | 0.531 | 0.862 | 0.247 |
| 19 | standard | 14 MM | 14.000 | 13.750 | 0.551 | 0.541 | 0.862 | 0.247 |
| 20 | "half" size | -16 mm (-5/8") | 15.676 | 15.426 | 0.617 | 0.607 | 0.960 | 0.323 |
| 21 | standard | 16 MM (5/8") | 15.926 | 15.676 | 0.627 | 0.617 | 0.960 | 0.323 |
| 22 | "half" size | -17 mm | 16.750 | 16.500 | 0.659 | 0.650 | 1.007 | 0.323 |
| 23 | standard | 17 MM | 17.000 | 16.750 | 0.669 | 0.659 | 1.007 | 0.323 |
| 24 | "half" size | -11/16" | 17.214 | 16.965 | 0.678 | 0.668 | 1.000 | 0.375 |
| 25 | standard | 11/16" | 17.463 | 17.214 | 0.688 | 0.678 | 1.000 | 0.375 |
| 26 | "half" size | -19 mm (-3/4") | 18.750 | 18.500 | 0.738 | 0.728 | 1.102 | 0.416 |
| 27 | standard | 19 MM (3/4") | 19.000 | 18.750 | 0.748 | 0.738 | 1.102 | 0.416 |

320 322 340

300

FIG. 5.

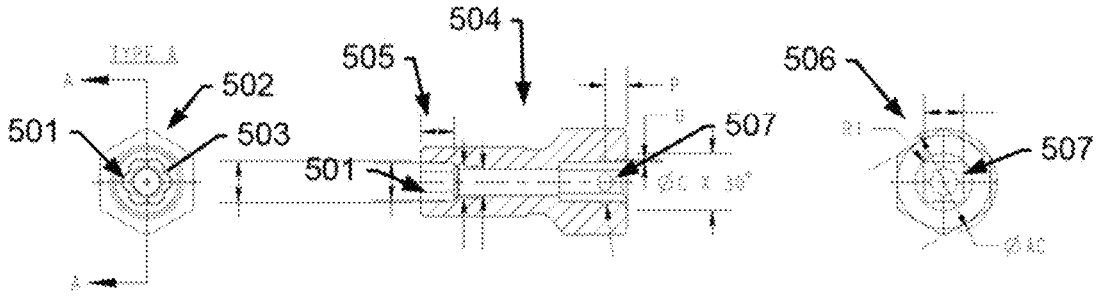
SECTION A-A FIG. 8A
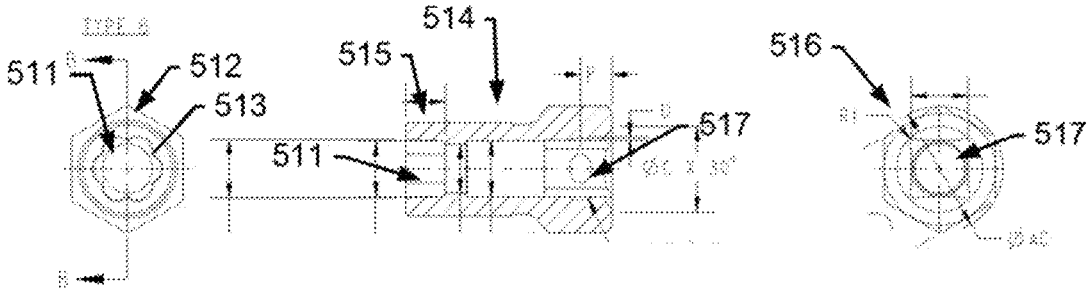
SECTION B-B
FIG. 8B
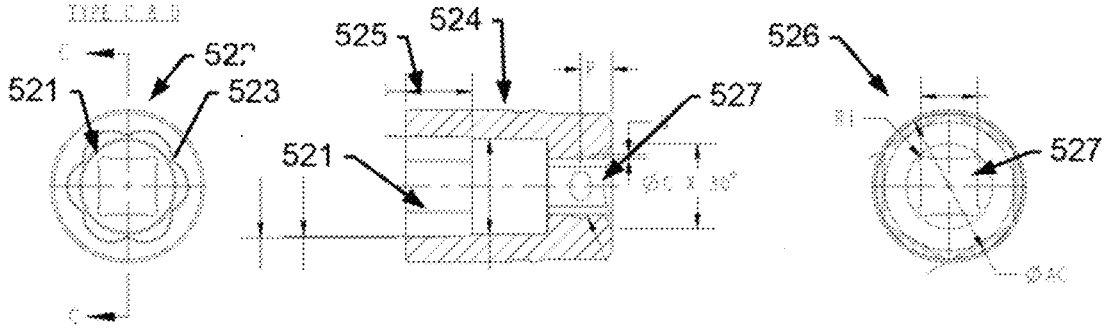
SECTION C-C
FIG. 8C 812 822 806

| ITEM NO. | LABELED SIZE | DIMENSION Np | Q | M | N | M-N | W | α (deg) | D | GV | J1 | J2 | Y1 | Y2 | AC | AF | C | U | P | INT. DRIVE | EXT. DRIVE | TYPE |
|---|---|---|---|---|---|---|---|---|---|---|---|---|---|---|---|---|---|---|---|---|---|---|
| 1 | 1/4IN- | 5.3 | 10.8 | 6.1 | 5.7 | 0.40 | 5.2 | 2.2 | 3.6 | 10 | 7.5 | 7.1 | 0.1 | 0.31 | 17.9 | 15.8 | 9.5 | 0.4 | 3.8 | 1/4" | 5/8" or 16MM | A |
| 2 | 1/4IN | 5.3 | 10.8 | 6.35 | 5.95 | 0.40 | 5.2 | 2.2 | 3.6 | 10 | 7.8 | 7.4 | 0.1 | 0.31 | 17.9 | 15.8 | 9.5 | 0.4 | 3.8 | 1/4" | 5/8" or 16MM | A |
| 3 | 7MM- | 5.3 | 11.6 | 6.75 | 6.2 | 0.55 | 5.7 | 2.8 | 4.4 | 10.8 | 8.3 | 7.7 | 0.1 | 0.39 | 17.9 | 15.8 | 9.5 | 0.4 | 3.8 | 1/4" | 5/8" or 16MM | A |
| 4 | 7MM | 5.3 | 11.6 | 7 | 6.45 | 0.55 | 5.7 | 2.8 | 4.4 | 10.8 | 8.6 | 8 | 0.1 | 0.39 | 17.9 | 15.8 | 9.5 | 0.4 | 3.8 | 1/4" | 5/8" or 16MM | A |
| 5 | 8MM- | 6.8 | 12.7 | 7.75 | 7.24 | 0.51 | 6.2 | 2.4 | 5.4 | 11.9 | 9.4 | 8.9 | 0.1 | 0.36 | 17.9 | 15.8 | 9.5 | 0.4 | 3.8 | 1/4" | 5/8" or 16MM | A |
| 6 | 8MM | 6.8 | 12.7 | 8 | 7.49 | 0.51 | 6.2 | 2.4 | 5.4 | 11.9 | 9.7 | 9.2 | 0.1 | 0.36 | 17.9 | 15.8 | 9.5 | 0.4 | 3.8 | 1/4" | 5/8" or 16MM | A |
| 7 | 3/8IN- | 8.4 | 16 | 9.28 | 8.8 | 0.48 | 6.7 | 2.1 | 9.5 | 15.2 | 11.2 | 10.7 | 0.15 | 0.4 | 21.4 | 18.9 | 14.5 | 0.6 | 5.4 | 3/8" | 3/4" or 19MM | B |
| 8 | 3/8IN | 8.4 | 16 | 9.53 | 9.05 | 0.48 | 6.7 | 2.1 | 9.5 | 15.2 | 11.5 | 11 | 0.15 | 0.4 | 21.4 | 18.9 | 14.5 | 0.6 | 5.4 | 3/8" | 3/4" or 19MM | B |
| 9 | 10MM- | 8.4 | 16 | 9.75 | 9.26 | 0.49 | 6.7 | 2.1 | 9.5 | 15.2 | 11.8 | 11.3 | 0.15 | 0.4 | 21.4 | 18.9 | 14.5 | 0.6 | 5.4 | 3/8" | 3/4" or 19MM | B |
| 10 | 10MM | 8.4 | 16 | 10 | 9.51 | 0.49 | 6.7 | 2.1 | 9.5 | 15.2 | 12 | 11.6 | 0.15 | 0.4 | 21.4 | 18.9 | 14.5 | 0.6 | 5.4 | 3/8" | 3/4" or 19MM | B |
| 11 | 11MM-_7/16IN- | 9.8 | 17.7 | 10.8 | 10.22 | 0.58 | 7.2 | 2.3 | 9.5 | 16.9 | 13 | 12.4 | 0.15 | 0.45 | 21.4 | 18.9 | 14.5 | 0.6 | 5.4 | 3/8" | 3/4" or 19MM | B |
| 12 | 11MM_7/16IN | 9.8 | 17.7 | 11.13 | 10.55 | 0.58 | 7.2 | 2.3 | 9.5 | 16.9 | 13.4 | 12.8 | 0.15 | 0.48 | 21.4 | 18.9 | 14.5 | 0.6 | 5.4 | 3/8" | 3/4" or 19MM | B |
| 13 | 12MM- | 10.7 | 19.4 | 11.75 | 11.13 | 0.62 | 8.2 | 2.2 | 10.7 | 18.6 | 14.1 | 13.4 | 0.2 | 0.52 | 21.4 | 18.9 | 14.5 | 0.6 | 5.4 | 3/8" | 3/4" or 19MM | C |
| 14 | 12MM | 10.7 | 19.4 | 12 | 11.38 | 0.62 | 8.2 | 2.2 | 10.7 | 18.6 | 14.4 | 13.7 | 0.2 | 0.52 | 21.4 | 18.9 | 14.5 | 0.6 | 5.4 | 3/8" | 3/4" or 19MM | C |
| 15 | 1/2IN- | 11.4 | 20.3 | 12.45 | 11.83 | 0.63 | 9.2 | 2.0 | 11.4 | 19.5 | 14.9 | 14.2 | 0.2 | 0.52 | 21.4 | 18.9 | 14.5 | 0.6 | 5.4 | 3/8" | 3/4" or 19MM | C |
| 16 | 1/2IN_13MM- | 11.4 | 20.3 | 12.7 | 12.07 | 0.63 | 9.2 | 2.0 | 11.4 | 19.5 | 15.2 | 14.5 | 0.2 | 0.52 | 21.4 | 18.9 | 14.5 | 0.6 | 5.4 | 3/8" | 3/4" or 19MM | C |
| 17 | 13MM | 11.4 | 20.3 | 13 | 12.43 | 0.57 | 9.2 | 1.8 | 11.4 | 19.5 | 15.5 | 14.9 | 0.2 | 0.49 | 21.4 | 18.9 | 14.5 | 0.6 | 5.4 | 3/8" | 3/4" or 19MM | C |
| 18 | 14MM- | 12.7 | 21.9 | 13.75 | 13.17 | 0.58 | 10.2 | 1.6 | 12.7 | 21.1 | 16.4 | 15.8 | 0.2 | 0.5 | 21.4 | 18.9 | 14.5 | 0.6 | 5.4 | 3/8" | 3/4" or 19MM | C |
| 19 | 14MM_9/16IN- | 12.7 | 21.9 | 14 | 13.42 | 0.58 | 10.2 | 1.6 | 12.7 | 21.1 | 16.7 | 16.1 | 0.2 | 0.5 | 21.4 | 18.9 | 14.5 | 0.6 | 5.4 | 3/8" | 3/4" or 19MM | C |
| 20 | 9/16IN | 12.7 | 21.9 | 14.28 | 13.7 | 0.58 | 10.2 | 1.6 | 12.7 | 21.1 | 17 | 16.4 | 0.2 | 0.5 | 21.4 | 18.9 | 14.5 | 0.6 | 5.4 | 3/8" | 3/4" or 19MM | C |
| 21 | 5/8IN-_16MM- | 14.8 | 23.9 | 15.7 | 15.18 | 0.52 | 10.7 | 1.4 | 14.8 | 23.1 | 18.6 | 18.1 | 0.25 | 0.51 | 23.9 | 21.9 | 14.5 | 0.6 | 5.4 | 3/8" | 7/8" or 22MM | D |
| 22 | 5/8IN_16MM | 14.8 | 23.9 | 16 | 15.48 | 0.52 | 10.7 | 1.4 | 14.8 | 23.1 | 19 | 18.5 | 0.25 | 0.51 | 23.9 | 21.9 | 14.5 | 0.6 | 5.4 | 3/8" | 7/8" or 22MM | D |
| 23 | 17MM- | 15.8 | 25.9 | 16.75 | 16.23 | 0.52 | 11.2 | 1.3 | 15.8 | 25.1 | 19.8 | 19.3 | 0.25 | 0.51 | 24.8 | 21.9 | 14.5 | 0.6 | 5.4 | 3/8" | 7/8" or 22MM | D |
| 24 | 17MM | 15.8 | 25.9 | 17 | 16.48 | 0.52 | 11.2 | 1.3 | 15.8 | 25.1 | 20.1 | 19.6 | 0.25 | 0.51 | 24.8 | 21.9 | 14.5 | 0.6 | 5.4 | 3/8" | 7/8" or 22MM | D |
| 25 | 11/16IN- | 16.3 | 25.9 | 17.21 | 16.7 | 0.51 | 11.2 | 1.3 | 16.3 | 25.1 | 20.4 | 19.9 | 0.25 | 0.51 | 24.8 | 21.9 | 14.5 | 0.6 | 5.4 | 3/8" | 7/8" or 22MM | D |
| 26 | 11/16IN | 16.3 | 25.9 | 17.46 | 16.95 | 0.51 | 11.2 | 1.3 | 16.3 | 25.1 | 20.7 | 20.2 | 0.25 | 0.51 | 24.8 | 21.9 | 14.5 | 0.6 | 5.4 | 3/8" | 7/8" or 22MM | D |
| 27 | 19MM-_3/4IN- | 17.7 | 28 | 18.7 | 18.12 | 0.58 | 13.2 | 1.3 | 17.7 | 27.2 | 22.1 | 21.5 | 0.25 | 0.54 | 24.8 | 21.9 | 14.5 | 0.6 | 5.4 | 3/8" | 7/8" or 22MM | D |
| 28 | 19MM_3/4IN | 17.7 | 28 | 19.05 | 18.47 | 0.58 | 13.2 | 1.3 | 17.7 | 27.2 | 22.5 | 21.9 | 0.25 | 0.54 | 24.8 | 21.9 | 14.5 | 0.6 | 5.4 | 3/8" | 7/8" or 22MM | D |

800 810 814 820 830 832 804 802

FIG. 11

EXTRACTOR SOCKET WITH BIDIRECTIONAL DRIVING CAPABILITY AND CORRESPONDING EXTRACTION SET WITH INTERMEDIATE SIZES

CROSS REFERENCE TO RELATED APPLICATION

This application claims priority to U.S. application No. 62/598,005 filed Dec. 13, 2017, the entire contents of which are hereby incorporated by reference in its entirety.

TECHNICAL FIELD

Example embodiments generally relate to socket tools and, in particular, relate to a socket tool that is configured to enable driving of fastening nuts or other drivable components in either direction, along with a set of such sockets that includes intermediate sizes.

BACKGROUND

Socket tools, such as socket wrenches, are familiar tools for fastening nuts, bolts, and other drivable components or fasteners. The sockets of these tools are commonly removable heads that interface with the ratchet, socket wrench, or other driver on one side and interface with one of various different sizes of nut, bolt head, or other fastener on the other side. Because high torque is often applied through these tools, and high strength and durability is desirable, the sockets are traditionally made of a metallic material such as iron or steel.

Sockets are generally made in sets that include different heads for each common size of fastener. The corresponding socket size for each common size of fastener is often the best tool that can be used to drive the fastener in either the tightening or loosening direction. In this regard, the shape of the socket head and fastening nut or fastener head is matched (e.g., typically hexagonal in shape), and the sizes are also very closely matched to ensure maximum surface contact and therefore even distribution of force to all of the faces of the fastening nut or fastener head. However, if the wrong size of socket head is used, or if an adjustable wrench or plier is used, it can often be the case that forces get concentrated on the corners of the fastening nuts (i.e., the transitions between the adjacent faces that form the familiar hexagonal shape). These concentrated forces can damage or strip the corners of the fastening nut or fastener head so that the corners become rounded. When the corners become sufficiently rounded, traditional sockets will slip when a significant force is applied or the socket may even be rendered useless and no longer be able to grip the fastener sufficiently to move it one or both directions. The risk of rounding can be exacerbated when fasteners are exposed to water, harsh chemicals, or other environments that can rust or corrode the fastener nut or head.

Although numerous designs of bolt extraction sockets have been proposed, these designs are all unidirectional. In this regard, these designs are generally tailored only for removal of the damaged fastener, and have no capability to drive a fastener (much less a damaged fastener). Thus, these designs assume that the best or only way to extract the fastener is to turn it in a single direction (i.e., the counterclockwise direction). Alternatively or additionally, these designs assume that the operator can replace the damaged fastener with a new (undamaged) fastener after removal of the damaged fastener. However, there are many instances where it is necessary to use the same (i.e., damaged) fastener that was removed. Moreover, there may also be situations where nuts are threaded on bolts in such a way that the extraction direction is actually clockwise instead of counterclockwise. Finally, it is also possible that driving the damaged fastener in the clockwise direction (or counterclockwise direction) is advantageous prior to driving the damaged fastener in the counterclockwise direction (or clockwise direction). In other words, in some cases, a directional change may facilitate driving of the damaged fastener in any direction. Additionally, in some cases, the stripping of a fastener may be so severe that even conventional unidirectional extraction sockets in conventional extraction socket sets are not capable of gripping the fastener and merely rotate around the fastener without moving it.

Thus, it may be desirable to provide a new design for an extractor socket and extractor socket set with improved performance, including a capability for bi-directionally gripping, driving, and removing fasteners, including severely rounded, corroded, or damaged fasteners.

BRIEF SUMMARY OF SOME EXAMPLES

Some example embodiments may enable the provision of a bidirectional extraction socket. The extraction socket may include a driven end configured to receive drive power from a driving tool, a drive end configured to interface with a fastener, and a body portion extending between the driven end and the drive end about an axis of the extraction socket. The drive end includes a fastener engagement recess extending into the body portion and coaxial with the body portion. The fastener engagement recess is configured to engage with the fastener such that the fastener is drivable in either a clockwise or a counterclockwise direction while avoiding contact with corner portions of the fastener.

In another example embodiment, a set of bidirectional extraction sockets may be configured to avoid contact with corner portions of fasteners being driven in either direction. The set of extraction sockets may include a first extraction socket having a first fastener engagement recess configured to receive a first standard size of fastener for bidirectional driving of the first standard size of fastener, a second extraction socket having a second fastener engagement recess configured to receive a second standard size of fastener for bidirectional driving of the second standard size of fastener, and a first intermediate extraction socket having a third fastener engagement recess configured to receive a fastener between the first and second standard sizes of fastener.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 5 illustrates a chart of size characteristics of various extraction sockets in a set of extraction sockets according to an example embodiment;

FIG. 8A illustrates a top view, side cross section view, and bottom view of the first type of an extraction socket according to an example embodiment;

FIG. 8B illustrates a top view, side cross section view, and bottom view of the second type of an extraction socket according to an example embodiment;

FIG. 8C illustrates a top view, side cross section view, and bottom view of the third type of an extraction socket according to an example embodiment;

FIG. 11 illustrates a chart of size characteristics of various extraction sockets in a set of extraction sockets depicted in FIGS. 6-10B according to an example embodiment.

DETAILED DESCRIPTION

Figure 1A:
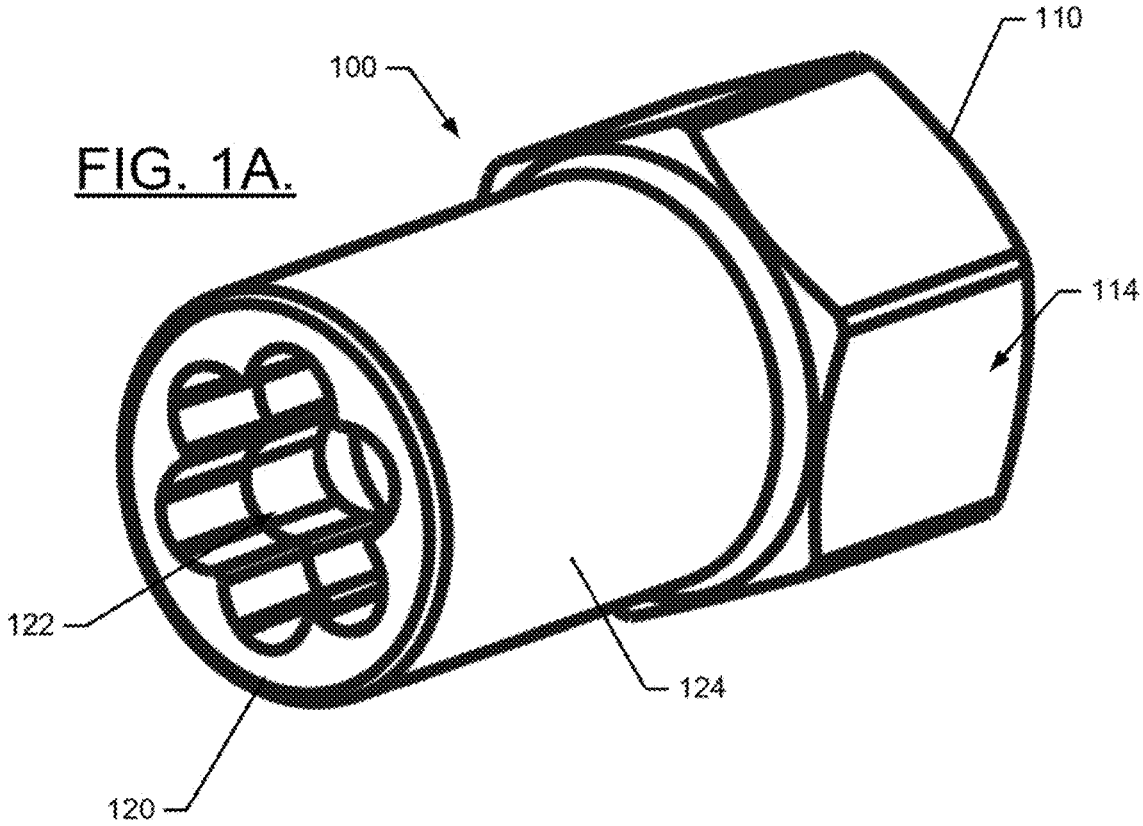
FIG. 1A illustrates a perspective view of a drive end of an extraction socket according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of bidirectional extractor socket head, and a socket set including a plurality of such bidirectional extractor socket heads that include intermediate sizes. Socket heads associated with example embodiments can therefore be used to drive fasteners (including damaged fastening nuts, screws, or bolts with rounded corners) in either direction. Moreover, socket sets according to example embodiments may be more capable of performing successful extractions because the sets include intermediate sizes (including intermediate sizes between adjacent standard sizes of both metric and Society of Automotive Engineers (SAE) socket sizes).

Figure 1B:
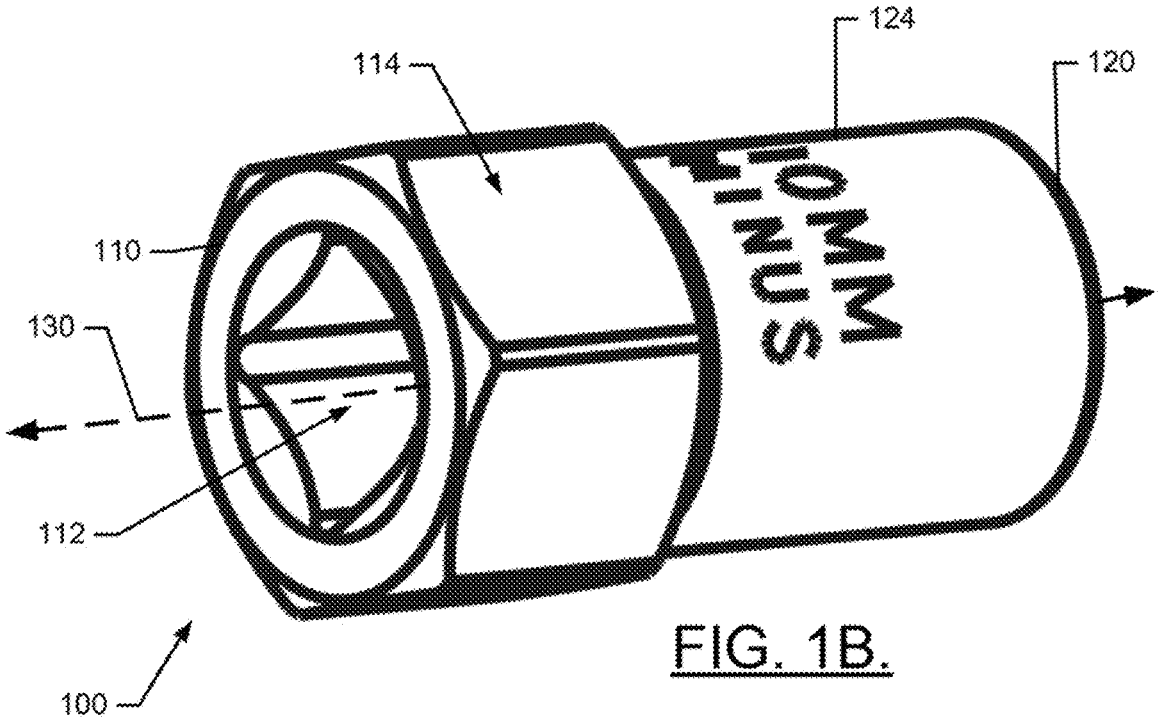
FIG. 1B illustrates a perspective view of a driven end of the extraction socket according to an example embodiment.
Figure 2A:
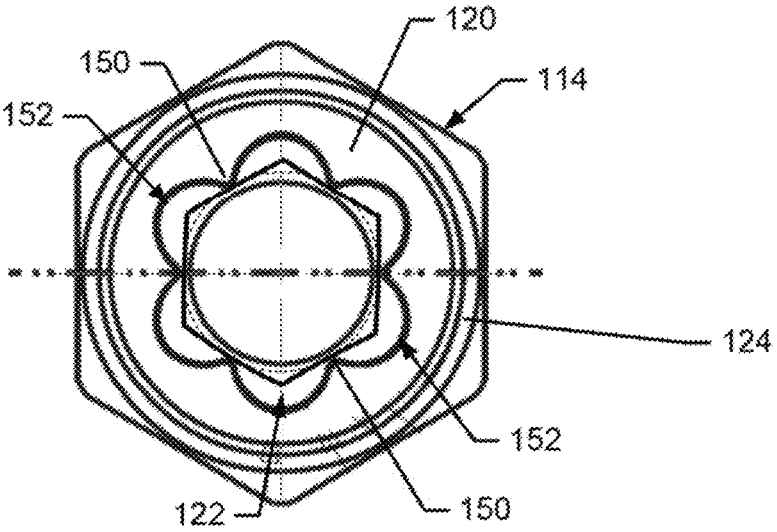
FIG. 2A illustrates a drive end of the extraction socket with a fastener received therein according to an example embodiment.
Figure 2B:
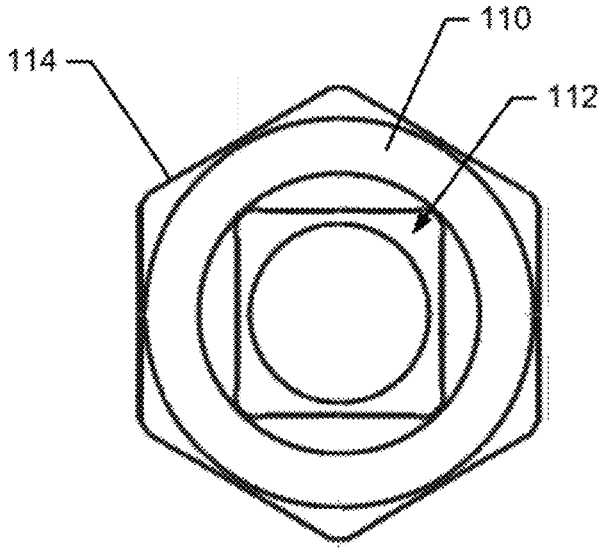
FIG. 2B illustrates a driven end of the extraction socket according to an example embodiment.
Figure 2C:
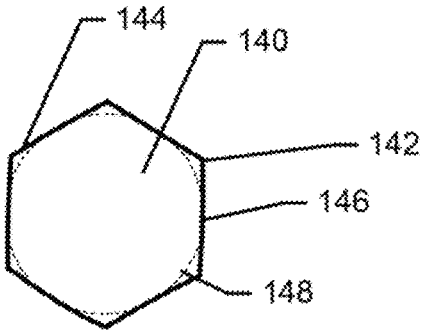
FIG. 2C illustrates a top view of a fastener according to an example embodiment.
Figure 3B:
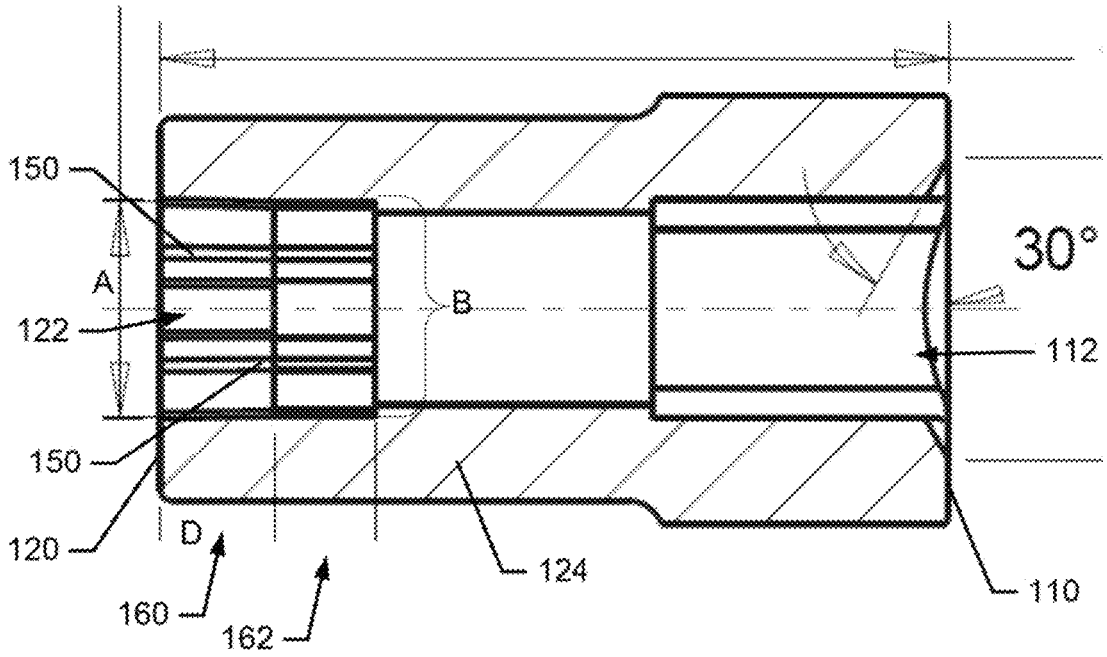
FIG. 3B illustrates a cross section view of the extraction socket taken along the axis of the extraction socket according to an example embodiment.
Figure 3A:
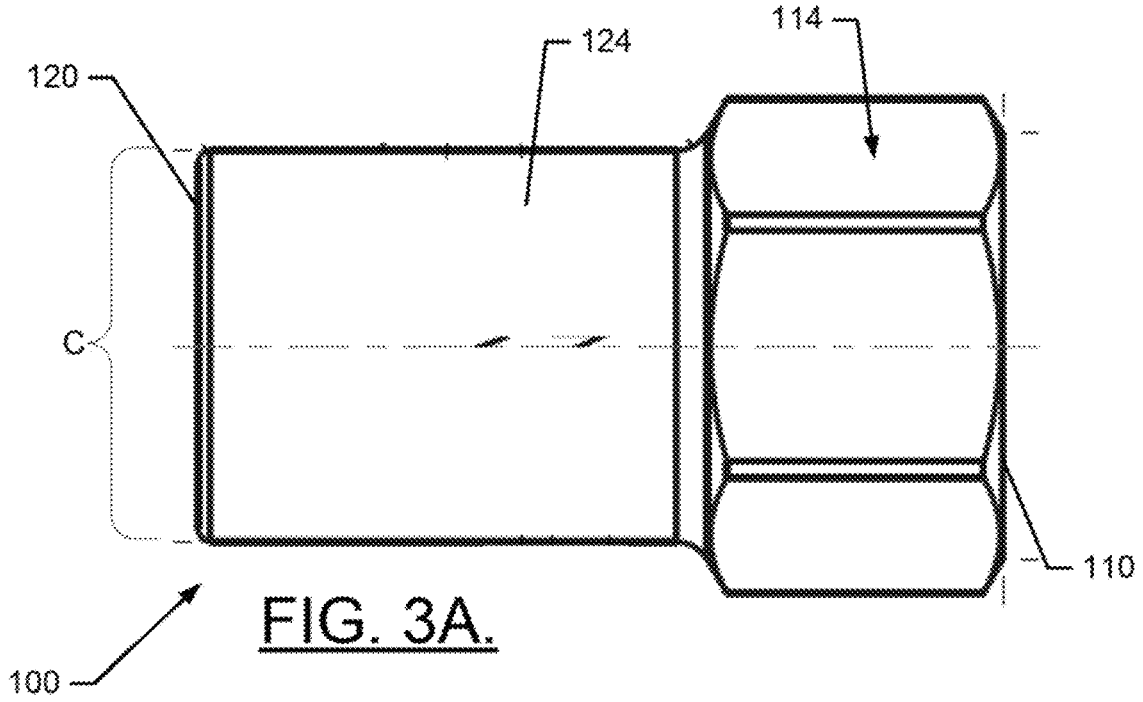
FIG. 3A illustrates a side view of the extraction socket according to an example embodiment.

FIG. 1, which is defined by FIGS. 1A and 1B, illustrates perspective views of a bidirectional extractor socket head (i.e., socket head 100) that is configured to drive fasteners (including damaged fasteners) in either direction (i.e., clockwise and counterclockwise or tightening and loosening directions). FIG. 2, which is defined by FIGS. 2A, 2B and 2C, illustrates front and back views of the socket head 100 to illustrate views of a driven end 110 and a drive end 120 of the socket head 100, and illustrates a top view of a hex head fastener (FIG. 2C). FIG. 3, which is defined by FIGS. 3A and 3B, illustrates a side view (FIG. 3A) and a cross section view (FIG. 3B) of the socket head 100 in accordance with an example embodiment.

Referring to FIGS. 1-3, it can be appreciated that the driven end 110 of the socket head includes a drive cavity 112 that may be configured to receive a square drive projection from a socket wrench, impact gun, socket extension, ratchet, and/or the like. The driven end 110 is otherwise formed as a hexagonal end face since a male hex assembly 114 extends away from the driven end 110. The male hex assembly 114 is configured to mate with a female hex assembly of a socket or wrench or an adjustable wrench or pliers. Thus, the driven end 110 may therefore be the end of the socket head 100 at which drive power is received from the wrench, socket, impact gun or other driving tool, by the socket head 100. Moreover, the driven end 110 of this example may be configured to be drivable by any of two different methods of applying the driving force (e.g., internal driving force along the axis (i.e., by the drive projection) or external driving force applied to the periphery of the driven end 110 (i.e., spaced apart from the axis)). As such, driving forces may be applied to the socket head 100 via at least two different driving tools proximate to the driven end 110. Additionally, and as stated above, the driving forces may be applied in either direction, as will be discussed in greater detail below.

The drive end 120 may be the end of the socket head 100 that interfaces with a fastener (e.g., a fastening nut such as a hex nut, a fastening head such as a hex head on a bolt or screw, or other fastener driven by a force applied to the periphery of the fastener nut or fastener head) to drive the fastener responsive to the driving force provided by the driving tool to the driven end 110. The drive end 120 may be shaped substantially as a circular end face that includes a fastener engagement recess 122 that is configured to engage the fastener to allow driving in either of the clockwise or counterclockwise directions. The socket head 100 may include a body portion 124 that extends from the male hex assembly 114 to the drive end 120. The body portion 124 may be a substantially cylindrical body that could have varying desired diameters based on the size of the engagement recess 122 as well as the strength requirements, socket material, manufacturing requirements, and access requirements for the particular application. Typically, the diameter of the body portion 124 will be selected based on a size of fastener that the fastener engagement recess 122 is designed to mate with. In this regard, for example, if the fastener engagement recess 122 is designed to mate with a ½ inch fastener, the diameter of the body portion 124 may be selected to be at least large enough to include the ½ inch sized fastener engagement recess 122 plus sufficient additional support material to allow large amounts of torque to be applied to the fastener via the socket head 100. In some cases, additional size of the diameter may range from 10% to 50%, but other sizes are also possible.

As can be appreciated from FIGS. 1-3, the end faces of the drive end 120 and the driven end 110 each lie in planes that are substantially parallel to each other and spaced apart from each other by the longitudinal length of the socket head 100. Meanwhile, the socket head 100 may have an axis 130 about which the socket head 100 rotates when forces are applied thereto. The axis 130 may form the longitudinal centerline of the socket head 100 and the body portion 124, and may extend substantially perpendicular to the end faces of the driven end 110 and the drive end 120.

Referring specifically to FIG. 2C, an example of the fastener 140 is shown, and may include six corner portions 142 disposed between six side faces 144. The six side faces 144 form a hexagonal shape where each adjacent set of side faces 144 meet at the corner portions 142. The side faces 144 may be substantially straight or flat faces that extend substantially parallel to an axis of the fastener 140. Opposing pairs of the side faces 144 may lie in planes that are parallel to each other. A midpoint 146 of each of the six side faces 144 may be disposed substantially half way between corner portions 142 that are disposed at respective ends of each respective one of the six side faces 144. Over time, or responsive to one or more events that may damage the fastener 140, the corner portions 142 may be stripped or otherwise removed or deformed to form rounded corners 148 shown in FIG. 2C.

The fastener engagement recess 122 may be configured to mate with the fastener 140 in such a way as to create a bidirectional engagement between the midpoint 146 of each of the side faces 144 of the fastener 140 (or a point near the midpoint 146) and the fastener engagement recess 122. In particular, the fastener engagement recess 122 may be defined by engagement ribs 150 that are defined between respective arc shaped grooves 152 or fluted portions. The arc shaped grooves 152 and the engagement ribs 150 may each extend in a direction substantially parallel to the axis 130 to define the depth of the fastener engagement recess 122. A distance between engagement ribs 150 on opposing sides of the fastener engagement recess 122 may define the inside diameter of the fastener engagement recess 122. This distance (i.e., the inside diameter of the fastener engagement recess 122) may be tapered along at least a portion of (and perhaps all of) the length of the engagement ribs 150 such that the engagement ribs 150 are farther apart from each other at the driven end 120 end of the engagement recess 122 than at any other point along the length of the engagement ribs 150. The arc shaped grooves 152 may provide clearance for any corrosion, burring, or other remaining portions of the corner portion 142 that may exist near the rounded corners 148 of a damaged instance of the fastener 140. In some embodiments, the apex of the each engagement rib 150, when viewed from the drive end 140 or a cross-section, substantially forms a corner, which may be a sharp corner that comes to point or may be somewhat rounded having a very small radius of curvature at the apex, such as a radius of substantially 0.5 mm or less.

Of course, on fastener 140 the distance between the side faces 144 on opposite sides of each other are normally equal along the entire length of the side faces 144. However, the engagement ribs 150 may be selected to define an initial inner diameter that is larger than the distance between the side faces 144 of the fastener 140 and may taper to an inner diameter that is smaller than the distance between the side faces 144 of the fastener. Thus, the tapered nature of the engagement ribs 150 will cause the engagement ribs 150 to be centered relative to the side faces 144 of the fastener 140 as the fastener 140 is inserted into the fastener engagement recess 122. In particular, after contact is first made between the engagement ribs 150 and the side faces 144, and the engagement ribs 150 slide along the side faces 144 for further insertion of the fastener 140 into the fastener engagement recess 122, the engagement ribs 150 automatically align with the midpoint 146 of the fastener 140 and begin to be tightly engaged therewith. Accordingly, when the fastener 140 is tightly engaged with and inserted into the fastener engagement recess 122, each of the six instances of the engagement ribs 150 will necessarily be in contact with a corresponding one of the midpoints 146 on a standard hex head or nut unless substantially worn or corroded unevenly. Even where substantially and unevenly worn, the fastener will be automatically and substantially centered between at least two opposing ribs that are in contact with a corresponding one of the midpoints 146 (or a point near to the midpoint).

The automatic centering of the engagement ribs 150 not only gives a tight engagement between the engagement ribs 150 and the side faces 144 (i.e., at the midpoint 146), but further creates such engagement in a way that means that turning the socket head 100 in either direction can be accomplished without repositioning the socket head 100. Thus, a reversible ratchet, a wrench or any other driving tool that can be configured to drive in both directions may simply be switched between directions without ever disengaging the socket head 100 so that driving can be accomplished in either direction. This, of course, can provide a huge advantage over a specialized fastener removal socket that is only configured for removal. Given that conventional removal sockets are only configured for removal, the designer's assumption is generally that the removed fastener will be discarded. Thus, care is not taken to preserve the integrity or condition of the fastener 140 by these specialized removers, and no opportunity for reuse is available to the operator. Operators that would either prefer to reuse the fastener 140, or must do so by necessity, are simply not offered any such option with such conventional removal sockets. Furthermore, the arc shaped grooves 152 of socket head 100 ensure that no further damage is done to the rounded corners 148, and the engagement ribs 150 have engaged the side faces 144 at their strongest point (i.e., midpoint 146) to facilitate no further damage and potential reuse (or at least dual direction driving capability) for the fastener 140 when the socket head 100 of example embodiments is used. In contrast, conventional removal sockets often cause significantly greater damage and deformation to the corners and/or leading edges of the fasteners.

Although the engagement ribs 150 may taper over their entire length in some cases, in other embodiments, the engagement ribs 150 may only taper over a tapered region 160 as shown in FIG. 3B. A fixed distance between the engagement ribs 150 may then be defined in a non-tapered region 162 that is farther from the drive end 120 than the tapered region 160. In some cases, the tapered region 160 may be longer than the non-tapered region 162. However, the length of the engagement ribs 150 (and the arc shaped grooves 152) may in any case be at least as long as the length of the side faces 144 of the fastener 140 that the socket head 100 is configured to engage.

Figure 4:
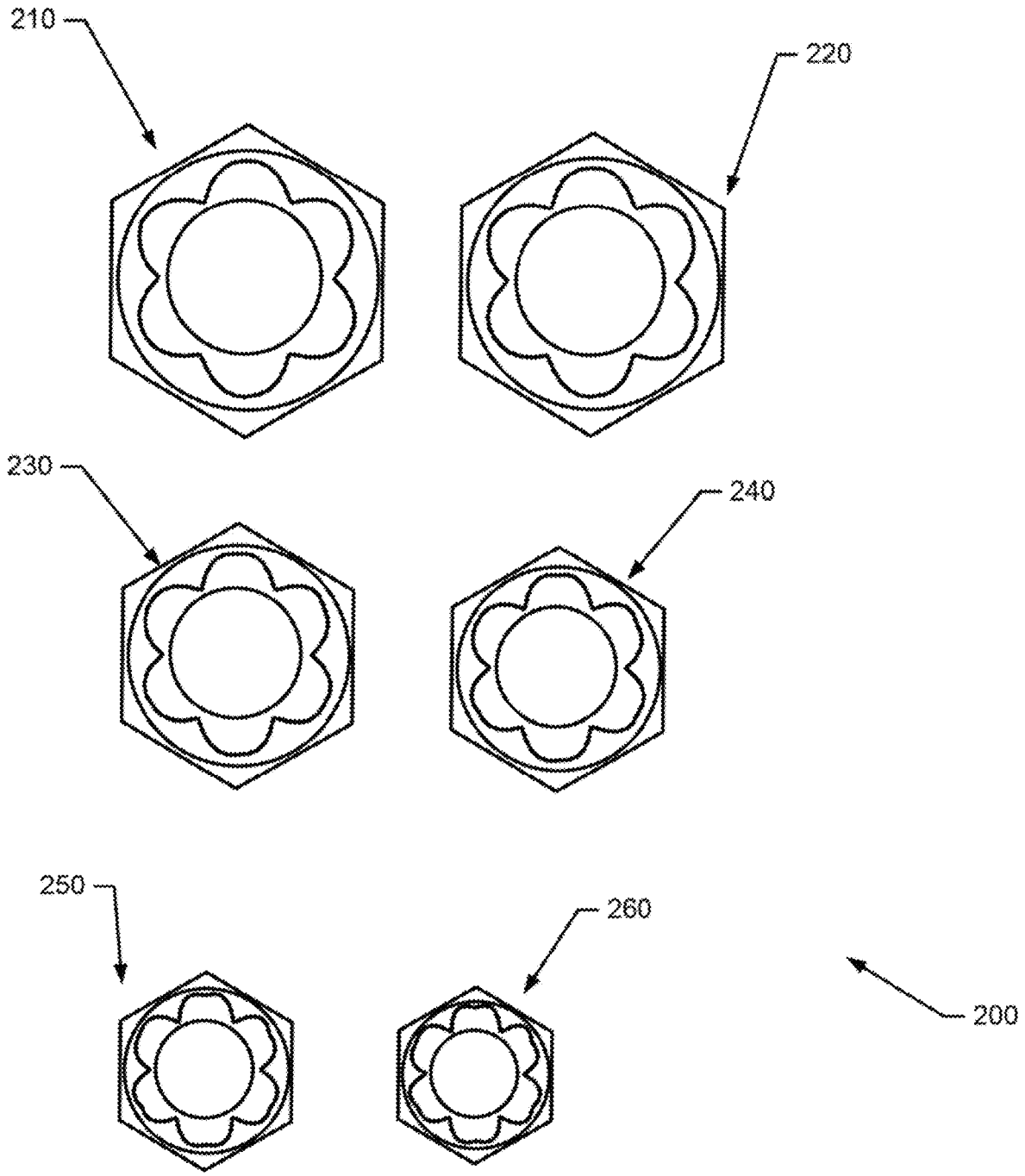
FIG. 4 illustrates a set of extraction sockets according to an example embodiment.
Figure 6:
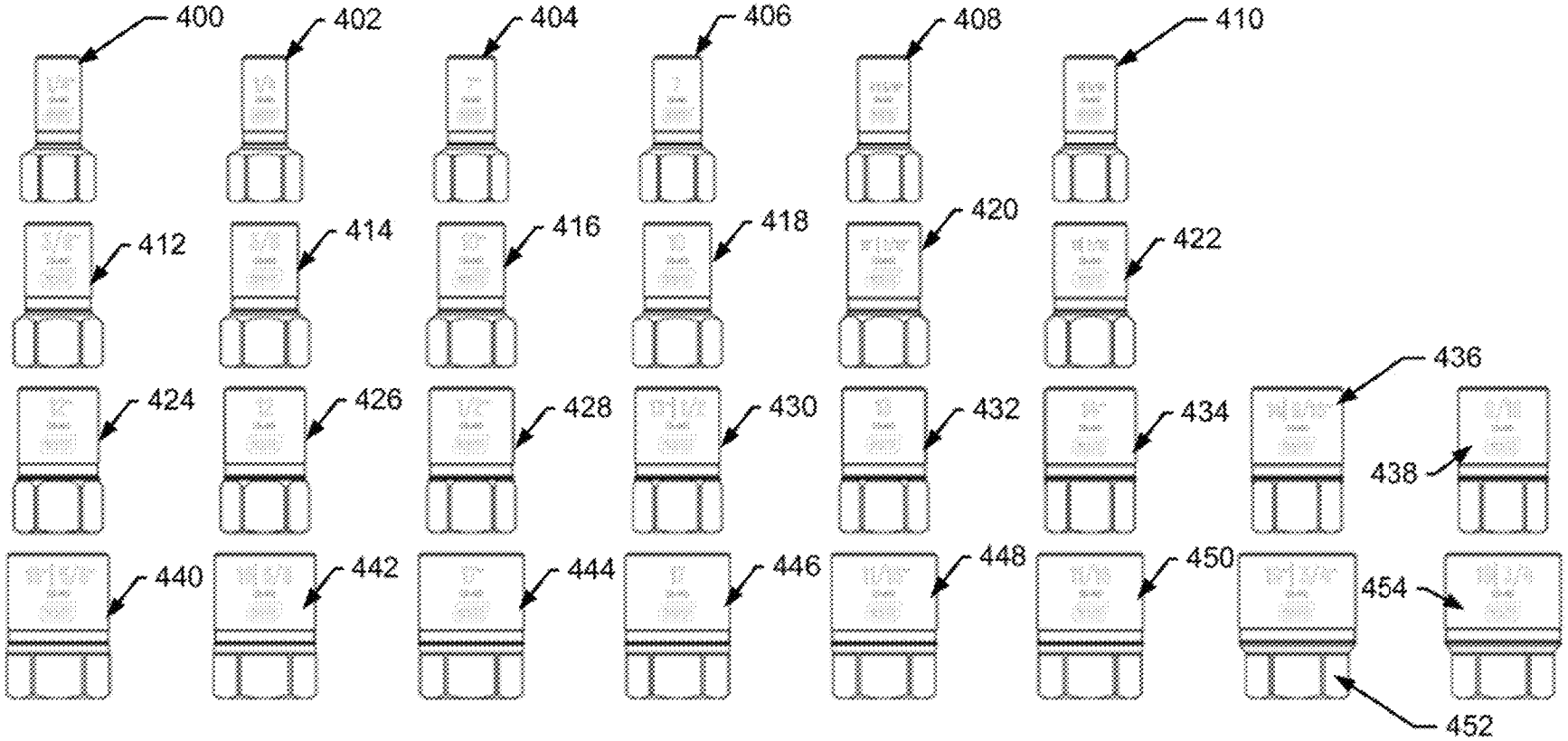
FIG. 6 illustrates an extraction socket set according to an example embodiment.

The socket head 100 of an example embodiment can be configured to fit any size of fastener 140. Thus, it may be desirable to provide a plurality of socket heads in a comprehensive set of bidirectional extractor sockets 200 as shown in FIGS. 4 and 6. The set of bidirectional extractor sockets 200 may include a first socket 210 that is configured to fit a standard size (SAE or metric) of fastener. However, rather than immediately providing the next socket in the set at the next standard size, in accordance with an example embodiment, a first intermediate socket 220 (or "minus size" socket) may be provided between the first socket 210 and a second socket 230 that is the next standard size down from the first socket 210. Similarly, a second intermediate socket 240 may be provided between the second socket 230 and the next standard sized socket down (i.e., third socket 250). A third intermediate socket 260 may also be provided for the third socket 250 to be sized between the next standard size down as well.

The first socket 210, the second socket 230, the third socket 250 and any number of additional sockets may each be sized to fit standard sized fasteners. Meanwhile, the first intermediate socket 220, the second intermediate socket 240, the third intermediate socket 260, and any number of additional intermediate sockets, may each be sized in between adjacent standard sizes. Thus, for fasteners that have been worn sufficiently to effectively reduce the length between opposing side faces, the intermediate sockets may be expected to mate securely with such fasteners to maintain the capability to drive the fasteners in both directions as discussed above.

Of note, the set of bidirectional extractor sockets 200 of one example embodiment may include a series of all standard metric sizes, and intermediate sizes between each adjacent one of the standard sizes. Meanwhile, another instance of the set of bidirectional extractor sockets 200 according to another example embodiment may include a series of all standard SAE sizes, and intermediate sizes between each adjacent one of the standard sizes. Still another example set of bidirectional extractor sockets 200 may include a series of all standard metric sizes and all standard SAE sizes, provided in order of decreasing or increasing size intermixing the two standard sizes, along with intermediate sizes between each adjacent one of the standard sizes.

FIG. 5 illustrates a chart 300 of extractor sizes and corresponding characteristics for an example set of bidirectional extractor sockets. In this regard, the chart 300 shows a listing of socket sizes 310 that includes a plurality of SAE and metric sizes that are considered standard. The listing also includes (between each standard size) a series of intermediate (or "half") sizes. Column 320 shows the inner diameter at the top (or widest part) of the fastener engagement recess 122 (i.e., proximate to the drive end 120) for each socket size in millimeters, and column 322 shows the inner diameter at the bottom (or narrowest part) of the fastener engagement recess 122 (i.e., at the distal end of the tapered portion 160) in millimeters. Column 330 shows the inner diameter at the top (or widest part) of the fastener engagement recess 122 (i.e., proximate to the drive end 120) for each socket size in inches, and column 332 shows the inner diameter at the bottom (or narrowest part) of the fastener engagement recess 122 (i.e., at the distal end of the tapered portion 160) in inches. Column 340 shows the outer diameter of the body portion 124 of the sockets and column 350 shows the length of taper for each tapered portion 160. Within this context, it should be appreciated that the inner diameter measures the distance between engagement ribs 150 on opposing sides of the fastener engagement recess 122.

As can be appreciated from FIG. 5, each intermediate size socket has a same taper length as one adjacent standard size socket and a different taper length than the other adjacent standard size socket. Meanwhile, each intermediate size socket also extends the inner diameter range of coverage of the one adjacent standard size socket while being discontinuous with the range of coverage of the other adjacent standard size socket. For example, the intermediate size socket between the standard 7 mm socket and the standard ¼ inch socket is the 7 mm "half" size socket. The 7 mm "half" size socket has the same length of taper (i.e., 0.118 inches) as the standard 7 mm socket, and also has a same largest inner diameter (0.266 inches) as the smallest inner diameter of the standard 7 mm socket. The standard 7 mm socket has an inner diameter range that extends from 0.276 inches to 0.266 inches and the 7 mm "half" size socket has an inner diameter range from 0.266 inches to 0.256 inches. Accordingly, the 7 mm "half" size effectively extends the inner diameter range for 7 mm fasteners from 0.276 inches to 0.256 inches to account for smaller (i.e., more worn) fasteners that do not quite fit in the standard ¼ inch socket, which has a length of taper that is 0.110 inches and an inner diameter range that is not coextensive with the 7 mm socket pair (i.e., 0.250 to 0.240 inches).

Thus, according to an example embodiment, a bidirectional extraction socket may be provided. The extraction socket may include a driven end configured to receive drive power from a driving tool, a drive end configured to interface with a fastener, and a body portion extending between the driven end and the drive end about an axis of the extraction socket. The drive end includes a fastener engagement recess extending into the body portion and coaxial with the body portion. The fastener engagement recess is configured to engage with the fastener such that the fastener is drivable in either a clockwise or a counterclockwise direction while avoiding contact with corner portions of the fastener.

In some embodiments, the extraction socket may be configured to include additional, optional features, and/or the features described above may be modified or augmented. Some examples of modifications, optional features and augmentations are described below. It should be appreciated that the modifications, optional features and augmentations may each be added alone, or they may be added cumulatively in any desirable combination. In an example embodiment, the driven end may include a drive cavity configured to receive a drive projection from a driving tool. In an example embodiment, a male hex assembly may be disposed proximate to the driven end to interface with a driving tool. In an example embodiment, the driven end may include a drive cavity configured to receive a drive projection from a first type of driving tool, and a male hex assembly may be disposed proximate to the driven end to interface with a second type of driving tool. In an example embodiment, the fastener engagement recess may include a plurality of engagement ribs, the engagement ribs extending inwardly toward the axis of the extraction socket and having respective lengths that extend in a direction substantially parallel to the axis of the extraction socket. In an example embodiment, the fastener engagement recess further includes a plurality of arc shaped grooves respective ones of which are formed between the engagement ribs such that the arc shaped grooves also have respective lengths that extend in the direction substantially parallel to the axis of the extraction socket. In an example embodiment, the arc shaped grooves may be configured to align with corner portions of the fastener where the corner portions are disposed between adjacent side faces of the fastener. In an example embodiment, a number of the engagement ribs may be equal to a number of side faces of the fastener. In an example embodiment, the engagement ribs may be disposed in pairs that extend inwardly toward each other to define an inner diameter between opposing ribs of each pair of engagement ribs, and the inner diameter may be largest at the drive end and may decrease along at least a portion of a length of the engagement ribs extending toward the driven end. In an example embodiment, the extraction socket may be configured such that a range in lengths of the inner diameter extends over a standard length between side faces of at least one standard size of fastener. In an example embodiment, the at least one standard size of fastener may be a metric standard size or a Society of Automotive Engineering (SAE) standard size. In an example embodiment, the extraction socket may be configured such that a range in lengths of the inner diameter does not extend over a standard length between side faces of at least one standard size of fastener, but is between two adjacent standard sizes of fastener. In an example embodiment, each of the engagement ribs may be configured to be self-centering relative to a midpoint of a corresponding side face of the fastener responsive to insertion of the fastener into the fastener engagement recess. In an example embodiment, the engagement ribs may have a tapered portion proximate to the drive end and a non-tapered portion extending from the tapered portion toward the driven end.

FIGS. 6-11 illustrate an example embodiment of an extraction set. FIG. 6 illustrates the extraction socket set, which comprises sockets of the following sizes: ¼ inch minus 400, ¼ inch 402, 7 mm minus 404, 7 mm 406, 8 mm minus (which is also 5/16 inch minus) 408, 8 mm (5/16 inch) 410, ⅜ inch minus 412, ⅜ inch 414, 10 mm minus 416, 10 mm 418, 11 mm minus (7/16 inch minus) 420, 11 mm (7/16 inch) 422, 12 mm minus 424, 12 mm 426, ½ inch minus 428, 13 mm minus (½ inch) 430, 13 mm 432, 14 mm minus 434, 14 mm (9/16 inch minus) 436, 9/16 inch 438, 16 mm minus (⅝ inch minus) 440, 16 mm (⅝ inch) 442, 17 mm minus 444, 17 mm 446, 11/16 inch minus 448, 11/16 inch 450, 19 mm minus (¾ inch minus) 452, and 19 mm (¾ inch) 454.

Figure 7C:
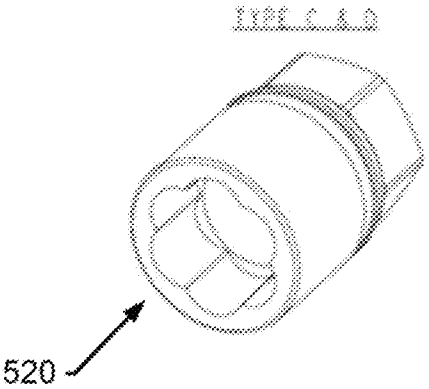
FIG. 7C illustrates a perspective view of a third type of an extraction socket according to an example embodiment.

The extraction set of FIG. 6 includes is comprised of four different types of sockets. Within this particular context, the term "type" of socket refers to corresponding different classifications of sockets based on their respective sizes and shapes at the drive and driven ends. FIG. 7A illustrates a perspective view of a first type of an extraction socket 500 according to an example embodiment. This first type is a "neck-down" socket (i.e., the drive end diameter is less than the driven end diameter) with a ¼ inch internal square drive and 16 mm external hex drive.

Figure 7B:
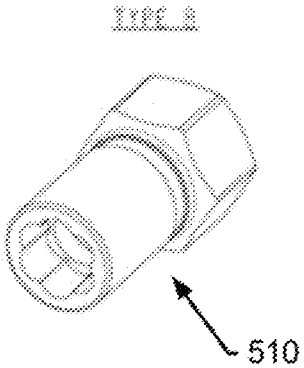
FIG. 7B illustrates a perspective view of a second type of an extraction socket according to an example embodiment.
Figure 7A:
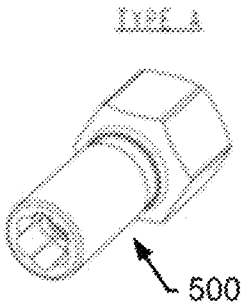
FIG. 7A illustrates a perspective view of a first type of an extraction socket according to an example embodiment.

FIG. 7B illustrates a perspective view of a second type of an extraction socket 510 according to an example embodiment. This second type is a "neck-down" socket with a ⅜ inch internal square drive and 19 mm external hex drive.

FIG. 7C illustrates a perspective view of one example of what could be formed as either a third type or a fourth type of an extraction socket 520 according to an example embodiment depending on the size of the external hex drive with which the extraction socket 520 is configured to interface. This third type is a "neck-up" socket (i.e., the drive end diameter is greater than the driven end diameter or substantially the same) with a ⅜ inch internal square drive and 19 mm external hex drive. This fourth type is a "neck-up" socket with a ⅜ inch internal square drive and 22 mm external hex drive. Therefore, in this example embodiment, the external hex drive of the sockets is not different across all sockets. This way, if a user is driving the extraction socket by the external drive using a wrench, the user will not necessarily always need to use a different sized wrench each time a different extraction socket is selected.

FIG. 8A illustrates a top view 502, side cross section view 504, and bottom view 506 of the first type of extraction socket 500 according to an example embodiment. The top view 502 essentially looks into a fastener engagement recess 501 of the extraction socket 500. Engagement ribs 503 are visible around a periphery of the fastener engagement recess 501. The engagement ribs 503 may extend into the drive end of the extraction socket 500 by a depth 505 that is sufficient to substantially fit a standard sized nut of a given size with which the extraction socket 500 is configured to interface. Meanwhile, the bottom view 506 essentially looks directly into a drive cavity 507 of the extraction socket 500.

FIG. 8B illustrates a top view 512, side cross section view 514, and bottom view 516 of the second type of extraction socket 510 according to an example embodiment. The top view 512 essentially looks into a fastener engagement recess 511 of the extraction socket 510. Engagement ribs 513 are visible around a periphery of the fastener engagement recess 511. The engagement ribs 513 may extend into the drive end of the extraction socket 510 by a depth 515 that is sufficient to substantially fit a standard sized nut of a given size with which the extraction socket 510 is configured to interface. Meanwhile, the bottom view 516 essentially looks directly into a drive cavity 517 of the extraction socket 510.

FIG. 8C illustrates a top view 522, side cross section view 524, and bottom view 526 of the third type of extraction socket 520 according to an example embodiment. The top view 522 essentially looks into a fastener engagement recess 521 of the extraction socket 520. Engagement ribs 523 are visible around a periphery of the fastener engagement recess 521. The engagement ribs 523 may extend into the drive end of the extraction socket 520 by a depth 525 that is sufficient to substantially fit a standard sized nut of a given size with which the extraction socket 520 is configured to interface. Meanwhile, the bottom view 526 essentially looks directly into a drive cavity 527 of the extraction socket 520.

Figure 9:
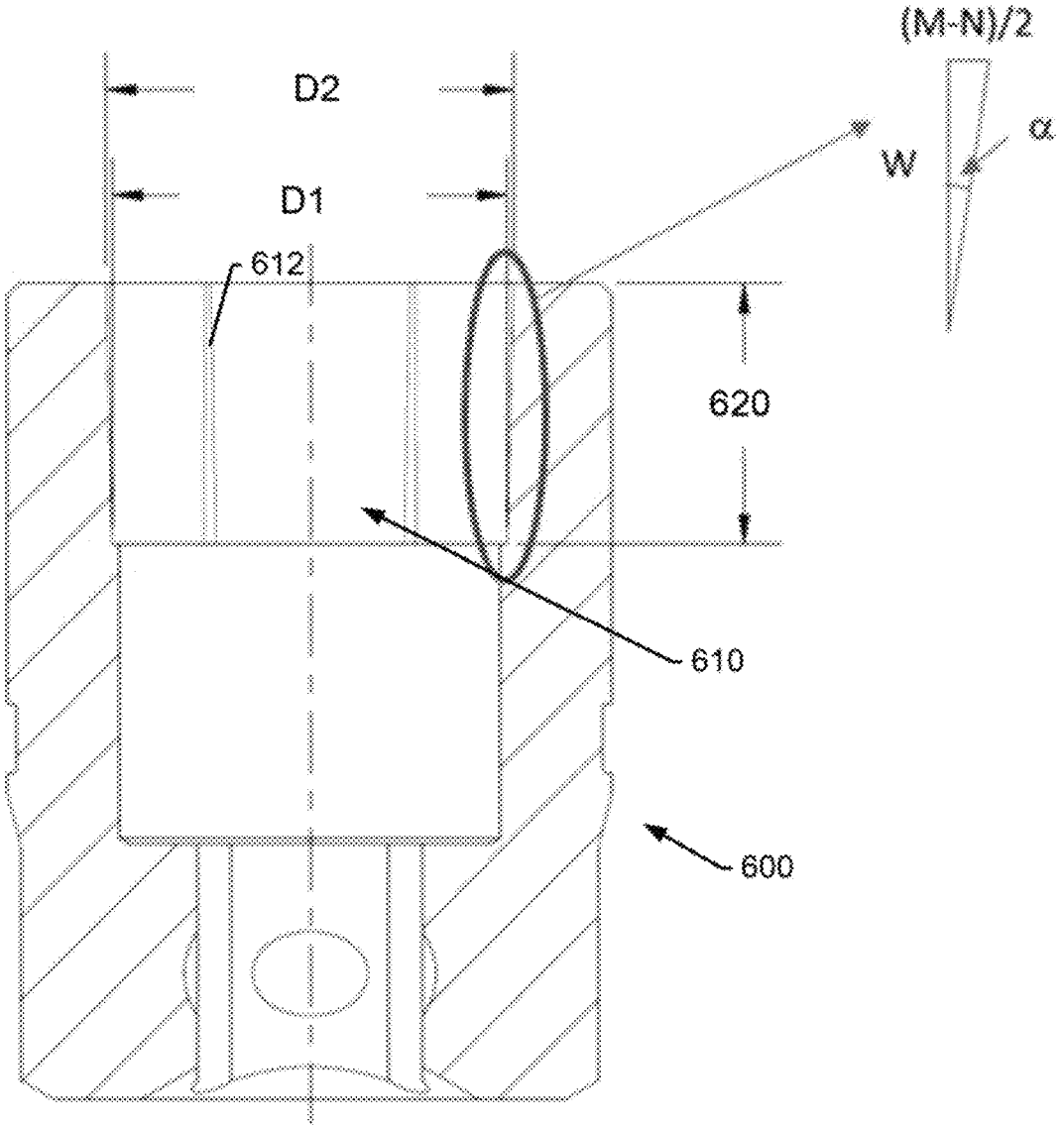
FIG. 9 illustrates a side cross section view of an extraction socket illustrating the tapered fastener engagement recess according to an example embodiment.

FIG. 9 illustrates a side cross section view of an extraction socket 600 illustrating the tapered fastener engagement recess 610 according to an example embodiment. As noted above, each of the engagement ribs 612 may taper along its longitudinal length so that an inner diameter of the fastener engagement recess 610 decreases as length along the engagement ribs increases. In this regard, a minimum inner diameter (D1) is less than a maximum inner diameter (D2), as shown in FIG. 9. Thus, over a depth 620 of the fastener engagement recess 610, the engagement ribs 612 expand outwardly at an angle of taper (a) relative to a plane parallel to an axis 630 of the extraction socket 600. In some cases, the angle of taper (a) may be less than about 10 degrees. Moreover, in some embodiments, the angle of taper (a) may be less than about 5 degrees. In this regard, for example, the angel of taper (a) may be between 1 and 3 degrees in some cases.

Figure 10A:
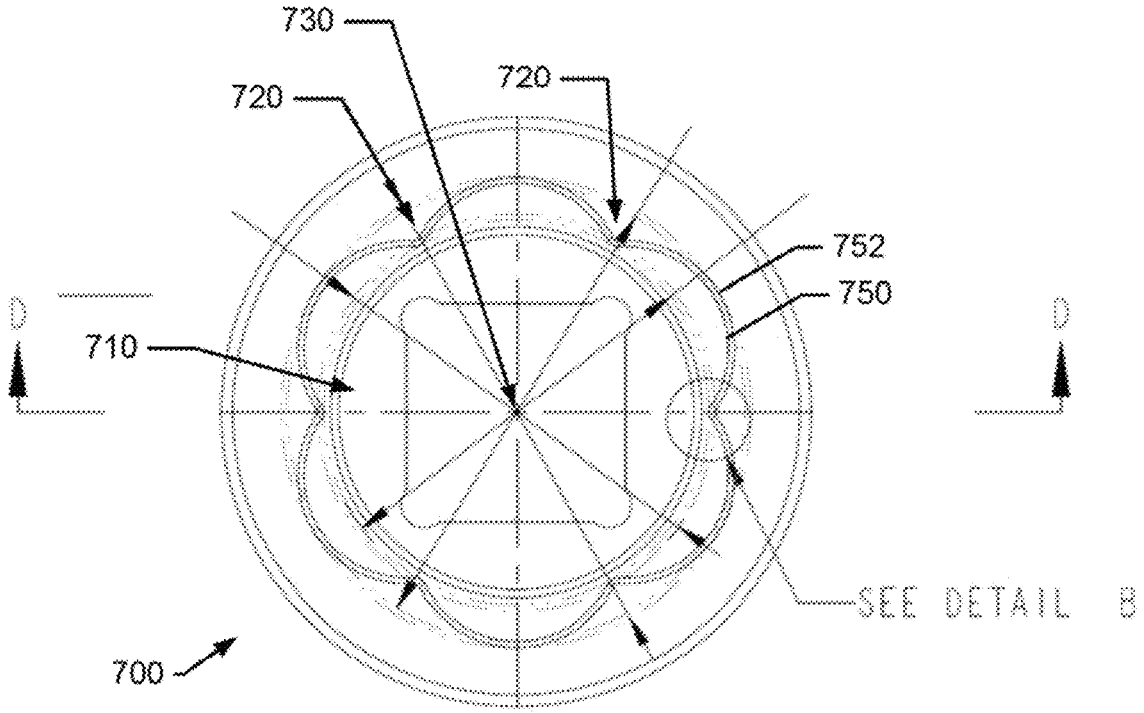
FIG. 10A illustrates a top view of an extraction socket illustrating the changes in diameter of the tapered fastener engagement recess according to an example embodiment.

FIG. 10A illustrates a top view of an extraction socket 700 illustrating the changes in diameter of the tapered fastener engagement recess 710 according to an example embodiment. In this regard, the engagement ribs 720 each extend inwardly toward an axis 730 of the extraction socket 700. As such, a periphery of the fastener engagement recess 710 is formed by alternating portions of smaller diameter (i.e., where the engagement ribs 720 are formed) and larger diameter (i.e., between the engagement ribs 720). The engagement ribs 720 are formed by surfaces that slant inwardly toward the axis 730 on opposite sides of an apex 740 that defines the minimum diameter for the fastener engagement recess 710 at any corresponding depth of the fastener engagement recess 710. As noted above, the engagement ribs 720 also slant toward the axis 730 as depth into the fastener engagement recess 710 increases. As a result, a first periphery 750 of the fastener engagement recess 710, at a deepest depth of the fastener engagement recess 710, has a smaller diameter at all points along its surface than a second periphery 752, at a shallowest depth of the fastener engagement recess 710. Although the apex 740 could be formed to define a point, some embodiments may instead form the apex 740 to be slightly rounded instead.

Figure 10B:
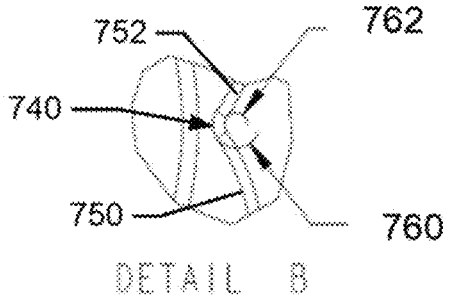
FIG. 10B illustrates a close up view of the apex of an engagement rib according to an example embodiment.

FIG. 10B illustrates a close up view of the apex 740 of one of the engagement ribs 720 according to an example embodiment. In particular, the apex 740 of FIG. 10B is shown to demonstrate that the apex 740 is not a sharp point, but has a small area of curvature. Moreover, in some example embodiments, the degree of curvature of the apex 740 may be formed such that the curvature gets slightly larger as depth into the tapered fastener engagement recess 710 increases. Given the change in diameter between the first periphery 750 and the second periphery 752, it can be appreciated that a first radius 760 defining the curvature of the apex 740 at the first periphery 750 is larger than a second radius 762 defining the curvature of the apex 740 at the second periphery 752, as shown in FIG. 10B.

FIG. 11 illustrates a chart of size characteristics of various extraction sockets in a set of extraction sockets depicted in FIGS. 6-10B according to an example embodiment. As shown in FIG. 11, a size column 800 defines each respective size of extractor socket. Type column 802 defines respective different socket types which, as noted above, are defined based on their internal and external drive characteristics. Internal drive column 804 shows internal drive characteristics and external drive column 806 shows external drive characteristics. Column 810 illustrates a largest fastener engagement recess diameter (in mm) for each socket, and column 812 illustrates a smallest fastener engagement recess diameter for each socket. Column 814 illustrates a difference therebetween. Column 820 illustrates angle of taper (a) and column 822 illustrates the depth of the fastener engagement recess for each socket. Column 830 illustrates the radius at the apex at a shallow end of the fastener engagement recess, and column 832 illustrates the radius at the apex at the deep end of the fastener engagement recess. It should be appreciated that the sizes and dimensions have been created after extensive research and experimentation to balance various, and often competing, performance characteristics such as strength, durability, size, access, cost, and convenience to the end user.

Lab results testing performance and life cycles for extraction sockets of example embodiments have demonstrated that extraction sockets formed as described herein have up to ten times longer impact life than conventional extractors. In particular, conventional extractors tested alongside a 5/16 inch extractor socket of an example embodiment experienced failures of hex mandrel corner rounding and socket bit edge deformation in less than 300 cycles. However, the extractor socket of an example embodiment did not receive any such failure after at least 500 cycles with an impact torque applied of 40 ft-lb. Example embodiments also experience up to five times greater torque output relative to conventional extractors. In this regard, testing showed that a peak torque of over 500 inch-pounds was achieved by example embodiments before corner rounding occurred, whereas all conventional extractors experienced failure at less than about 155 inch-pounds for a 5/16 inch extractor overload test on 75% rounded hex nuts. ½ inch overload tests on 75% rounded hex nuts demonstrated failure for example embodiments at about 1579 inch-pounds of peak torque, whereas all conventional extractors failed by less than about 265 inch-pounds of peak torque. Meanwhile, for a ¾ inch overload test on 75% rounded hex nuts, example embodiments did not fail at all by 5500 inch-pounds of peak torque (at which point testing was suspended), whereas each conventional extractor had failed by less than about 320 inch-pounds of peak torque. Testing for removal of a fastener followed by reuse of the same fastener also illustrated superior results. In this regard, for example, the fastener engagement recess of example embodiments proved to be configured to engage with the fastener for removal of the fastener and subsequently engage with the same fastener to reuse the fastener and achieve both a peak removal torque and a peak installation torque of greater than about 500 inch-pounds. No conventional extractor tested was able to achieve such results. Thus, not only can example embodiments outperform the competition in robustness and longevity, but the bi-directional nature of example embodiments may further allow the same damaged, weathered, rusted and/or corroded fastener to not only be removed, but to be reused if no suitable alternative is available.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A bidirectional extraction socket comprising:

a driven end configured to receive drive power from a driving tool;

a drive end configured to interface with a fastener of an intended width, the fastener having six side faces;

a body portion extending between the driven end and the drive end about an axis of the extraction socket; and an indicia disposed on the bidirectional extraction socket indicating the intended width of the fastener to be operated upon by the bidirectional extraction socket;

wherein the drive end comprises a fastener engagement recess extending into the body portion and coaxial with the body portion, the fastener engagement recess being configured to engage with the fastener such that the fastener is drivable in either a clockwise or a counterclockwise direction while avoiding contact with corner portions of the fastener, wherein the fastener engagement recess has six engagement ribs, wherein each engagement rib defines an apex having a maximum that lies in a straight line extending a length of each engagement rib, wherein the engagement ribs are disposed in pairs that extend inwardly toward each other to define an inner diameter between opposing ribs of each pair of engagement ribs, wherein the inner diameter is largest at the drive end and decreases along a length of the engagement ribs extending toward the driven end such that the apex of each engagement rib tapers inward toward the axis of the extraction socket at an angle of between 1 and 5 degrees, the inner diameter between the opposing ribs of each pair of engagement ribs having a minimum length that is less than the intended width of the fastener, wherein each apex has a radius of curvature that is a minimum radius at the drive end and increases along the length of the engagement ribs extending toward the driven end to a maximum radius, a difference between the maximum radius and the minimum radius being greater than 0.21 millimeters, wherein each apex is disposed between concave, arc shaped grooves that are symmetrical about the apex of each of the engagement ribs, wherein each apex has a convex, circular arc shape, wherein a contact area formed by the convex, circular arc shape of each apex is an only area that contacts a side face of the fastener during an extraction of the fastener and only one apex contacts each side face of the fastener during the extraction.

2. The extraction socket of claim 1, wherein the driven end comprises a drive cavity configured to receive a drive projection from a driving tool.

3. The extraction socket of claim 1, wherein a male hex assembly is disposed proximate to the driven end to interface with a driving tool.

4. The extraction socket of claim 1, wherein the driven end comprises a drive cavity configured to receive a drive projection from a first type of driving tool, and wherein a male hex assembly is disposed proximate to the driven end to interface with a second type of driving tool.

5. The extraction socket of claim 1, wherein each of the arc shaped grooves is formed between the engagement ribs such that each of the arc shaped grooves has a respective length that extends parallel to the axis of the extraction socket.

6. The extraction socket of claim 5, wherein each of the arc shaped grooves is configured to align with corner portions of the fastener, the corner portions being disposed between adjacent side faces of the fastener.

7. The extraction socket of claim 1, wherein the extraction socket is configured such that a range in lengths of the inner diameter extends over a standard length between side faces of at least one standard size of fastener.

8. The extraction socket of claim 7, wherein the at least one standard size of fastener is a metric standard size or a Society of Automotive Engineering (SAE) standard size.

9. The extraction socket of claim 1, wherein the extraction socket is configured such that a range in lengths of the inner diameter does not extend over a standard length between side faces of at least one standard size of fastener, but is between two adjacent standard sizes of fastener.

10. The extraction socket of claim 1, wherein each of the engagement ribs is configured to be self-centering relative to a midpoint of a corresponding side face of the fastener responsive to insertion of the fastener into the fastener engagement recess.

11. The extraction socket of claim 1, wherein the fastener engagement recess is configured to engage with the fastener for removal of the fastener and subsequently engage with the fastener to reuse the fastener and achieve both a peak removal torque and a peak installation torque of greater than about 500 inch-pounds.

12. The extraction socket of claim 1, wherein each of the engagement ribs maintains constant radial spacing between consecutive engagement ribs over the entire length of each of the engagement ribs.

13. The extraction socket of claim 12, wherein the engagement ribs are spaced radially around the axis of the extraction socket by 60 degrees.

14. The extraction socket of claim 1, wherein the apex of each of the engagement ribs has a minimum radius of curvature not greater than 0.5 mm.

15. A bidirectional extraction socket comprising:

a driven end configured to receive drive power from a driving tool;

a drive end configured to interface with a fastener of an intended width, the fastener having six side faces;

a body portion extending between the driven end and the drive end about an axis of the extraction socket; and an indicia disposed on the bidirectional extraction socket indicating the intended width of the fastener to be operated upon by the bidirectional extraction socket;

wherein the drive end comprises a fastener engagement recess that extends into the body portion and is coaxial with the body portion, the fastener engagement recess being configured to engage with the fastener such that the fastener is drivable in either a clockwise or a counterclockwise direction while avoiding contact with corner portions of the fastener, wherein the driven end comprises a drive cavity configured to receive a drive projection from the driving tool, wherein the fastener engagement recess has six engagement ribs, wherein the engagement ribs comprise a tapered portion proximate to the drive end and a non-tapered portion extending from the tapered portion toward the driven end, wherein the tapered portion of each of the engagement ribs tapers inward toward the axis of the extraction socket and the non-tapered portion of each of the engagement ribs extends parallel to the axis of the extraction socket, wherein each engagement rib defines an apex having a maximum that extends toward the axis of the extraction socket along a length of the engagement rib and the maximum extends along the length of the engagement rib in a common plane with the axis of the extraction socket, wherein the engagement ribs are disposed in pairs that extend inwardly toward each other to define an inner diameter between opposing ribs of each pair of engagement ribs, wherein the inner diameter is largest at the drive end and decreases along at least a portion of a length of the engagement ribs extending toward the driven end such that the apex of each engagement rib tapers inward toward the axis of the extraction socket at an angle of between 1 and 5 degrees, the inner diameter between the opposing ribs of each pair of engagement ribs having a minimum length that is less than the intended width of the fastener, wherein each apex has a radius of curvature that is a minimum radius at the drive end and increases along the length of the engagement ribs extending toward the driven end to a maximum radius, a difference between the maximum radius and the minimum radius being greater than 0.21 millimeters, wherein each apex is disposed between concave, arc shaped grooves that are symmetrical about the apex of each of the engagement ribs, wherein each apex has a convex, circular arc shape, wherein a contact area formed by the convex, circular arc shape of each apex is an only area that contacts a side face of the fastener during an extraction of the fastener and only one apex contacts each side face of the fastener during the extraction.

16. The extraction socket of claim 15, wherein the apex of each engagement rib tapers inward toward the axis of the extraction socket at an angle of between 1 and 3 degrees.

* * * * *